US006652005B2

(12) United States Patent
Meischen

(10) Patent No.: US 6,652,005 B2
(45) Date of Patent: Nov. 25, 2003

(54) MEAT PRODUCT LABELING AND ORGANIZING METHOD

(75) Inventor: Herb W. Meischen, Wichita, KS (US)

(73) Assignee: Excel Corporation, Wichita, KS (US)

( * ) Notice: Subject to any disclaimer, the term of this patent is extended or adjusted under 35 U.S.C. 154(b) by 87 days.

(21) Appl. No.: 09/753,471

(22) Filed: Jan. 3, 2001

(65) Prior Publication Data

US 2003/0197367 A1 Oct. 23, 2003

(51) Int. Cl.[7] ..... B42D 15/00

(52) U.S. Cl. ..... 283/81; 283/56; 283/74; 283/79

(58) Field of Search ..... 426/129, 118; 156/64, 277, 361, 384, 244.16, 257; 283/81, 74, 56, 79

(56) References Cited

U.S. PATENT DOCUMENTS

| | | | | |
|---|---|---|---|---|
| 4,107,337 A | | 8/1978 | Deppner, Jr. | 426/266 |
| 4,165,392 A | | 8/1979 | Kawai et al. | 426/657 |
| 4,281,022 A | | 7/1981 | Buck | 426/233 |
| 4,857,121 A | * | 8/1989 | Markley et al. | 156/64 |
| 4,880,659 A | | 11/1989 | Akiyama et al. | 426/656 |
| 5,230,915 A | | 7/1993 | Shahidi et al. | 426/240 |
| 5,247,460 A | | 9/1993 | LaBudde | 364/552 |
| 5,558,742 A | * | 9/1996 | Kiefer | 156/244.16 |
| 6,015,583 A | | 1/2000 | Krebs et al. | 426/396 |
| 6,088,114 A | | 7/2000 | Richmond et al. | 356/417 |
| 6,221,411 B1 | * | 4/2001 | Sanfilippo et al. | 426/129 |

* cited by examiner

*Primary Examiner*—Willmon Fridie, Jr.
(74) *Attorney, Agent, or Firm*—Dorsey & Whitney LLP

(57) ABSTRACT

A system and method for applying labels to a meat product and organizing a meat display case for ease of use by the consumer. The method of the present invention includes collecting PLU codes and corresponding product descriptions from a retailer, associating each PLU code with one or more preparation characteristic, using simple, easy-to-understand symbols, and applying a label to the meat product that the consumer can read and understand quickly and easily. In one embodiment, the present invention further includes a method for organizing a retailer's meat display case for facilitating desired product selection by the consumer.

19 Claims, 8 Drawing Sheets

120

66

BEEF *Made Easy & Delicious*

POT ROAST

COOK 1HR+ TIME

MARINATE FOR TENDERNESS

BRISKET

| Sell By | Use Or Freeze By | Total Price |
|---|---|---|
| Aug 23,00 | Aug 23,00 | $12.29 |
| Net Wt./Ct. | Unit Price | |
| 0.85/lb | $3.19/lb | |

POT ROASTING TIPS

- PLACE MEAT FAT SIDE UP IN A COVERED ROASTING PAN AND ADD WATER
- ROAST AT 325 DEGREES IN AN OVEN FOR 25-30 MINUTES PER POUND
- INSERT MEAT THERMOMETER. COOK TO INTERNAL TEMPERATURE OF 150 DEGREES
- AFTER TAKING ROAST OUT OF OVEN, LET IT SIT FOR 10-15 MINUTES BEFORE SERVING 12345 67890

CUSTOMER INFORMATION LINE: 1-800-213-9040

Fig. 4A

122

BEEF *Made Easy & Delicious*

60

PAN FRY STIR FRY

COOK 15 TIME

NATURALLY TENDER

STIR FRY

| Sell By | Use Or Freeze By | Total Price |
|---|---|---|
| Aug 23,00 | Aug 23,00 | $12.29 |
| Net Wt./Ct. | Unit Price | |
| 0.85/lb | $3.19/lb | |

STIR FRY/PAN FRY TIPS

- HEAT A SMALL AMOUNT OF OIL IN A SKILLET OR A FRYING PAN OVER MEDIUM-HIGH HEAT HEAT UNTIL HOT
- PLACE MEAT IN PRE-HEATED SKILLET
- DO NOT ADD WATER. DO NOT COVER
- COOK MEAT FOR 3-4 MINUTES, TURNING TO MAKE SURE THE MEAT COOKS EVENLY 12345 67890

CUSTOMER INFORMATION LINE: 1-800-213-9040

Fig. 4B

120

64

PORK *Made Easy & Delicious*

OVEN ROAST

COOK 1HR+ TIME

NATURALLY TENDER

LOIN ROAST

| Sell By | Use Or Freeze By | Total Price |
|---|---|---|
| Aug 23,00 | Aug 23,00 | $12.29 |
| Net Wt./Ct. | Unit Price | |
| 0.85/lb | $3.19/lb | |

OVEN ROASTING TIPS

- PLACE MEAT FAT SIDE UP ON A RACK IN A OVEN ROASTING PAN
- ROAST AT 325 DEGREES IN AN OVEN FOR 25-30 MINUTES PER POUND
- INSERT MEAT THERMOMETER, COOK TO INTERNAL TEMPERATURE OF 150 DEGREES
- AFTER TAKING ROAST OUT OF THE OVEN, LET SIT FOR 10-15 MINUTES BEFORE SERVING 12345 67890

CUSTOMER INFORMATION LINE: 1-800-213-9040

Fig. 4C

MEAT PRODUCT LABELING AND ORGANIZING METHOD

CROSS-REFERENCE TO RELATED APPLICATION(S)

None.

BACKGROUND OF THE INVENTION

The present invention relates to a meat product labeling method and a display case organization method. More particularly, it relates to a meat product labeling method that provides easy to understand information relating to the meat product to which the label is attached, including preparation information.

Consumer demand for red meat products has been in a steady decline since 1980. Industry data shows that since 1980, the average retail price of beef products has declined approximately 40%, and the average volume of beef products sold has declined approximately 10%. Similarly, the average retail price of pork products has declined approximately 17%, and volume of pork products sold has declined approximately 10%. In that same time period, in an effort to combat the erosion of price and volume sold for red meat products, meat manufacturers have significantly increased the number and diversity of red meat products available to consumers. Despite this effort by manufacturers to increase the options available to consumers, average price and volume continue to erode.

Consumer research has shown that consumers of meat products typically have a limited repertoire of red meat cuts that they are familiar and comfortable with, and that they purchase on a regular basis from their local retailer. Of the approximately 400 distinct cuts of red meat, research shows that a consumer classified as a "novice" cook will regularly purchase only two to three cuts of beef products (e.g., tenderloin, sirloin, and t-bone steaks) and one cut of pork products (e.g., spare ribs and pork chops), and a consumer classified as a "gourmet" cook will regularly purchase six cuts of beef products and two cuts of pork products. Consumer research shows that the major reasons behind the limited repertoire of the consumers is that consumers have a narrow comfort zone (i.e., product familiarity), and consumers typically have significant constraints on the amount of time available for selecting a product from a retailer's case and for preparation of the product in their home.

There is a need in the art for a system and method of labeling and organizing meat products at the retail level to expand consumer repertoire and satisfaction of use thereby increasing demand for meat product generally.

BRIEF SUMMARY OF THE INVENTION

The present invention is a method for labeling meat products, for organizing a meat product display case, and for improving sales of meat products by assisting the consumer in quickly selecting the proper meat product for the desired occasion. In one embodiment, the present invention includes a method of generating a label containing characteristic preparation information for a meat product. The method includes collecting a plurality of meat product look-up codes and descriptions from a retailer, associating at least one preparation characteristic with each product look-up ("PLU") code and description, and generating a product label including the PLU code, the corresponding description, and the preparation characteristic.

In another embodiment, the present invention includes a method of organizing a meat product display case. The method includes placing meat products in the display case according to a preparation characteristic and attaching labels to the display case to clearly identify a portion of the display case as containing meat products having that preparation characteristic.

Still other embodiments of the present invention will become apparent to those skilled in the art from the following detailed description, wherein is shown and described only the embodiments of the invention by way of illustration of the best modes contemplated for carrying out the invention. As will be realized, the invention is capable of modification in various obvious aspects, all without departing from the spirit and scope of the present invention. Accordingly, the drawings and detailed description are to be regarded as illustrative in nature and not restrictive.

BRIEF DESCRIPTION OF THE DRAWINGS

FIGS. 4A–4C are top views of meat product labels for three different meat products according to an embodiment of the present invention.

DETAILED DESCRIPTION

Figure 1:
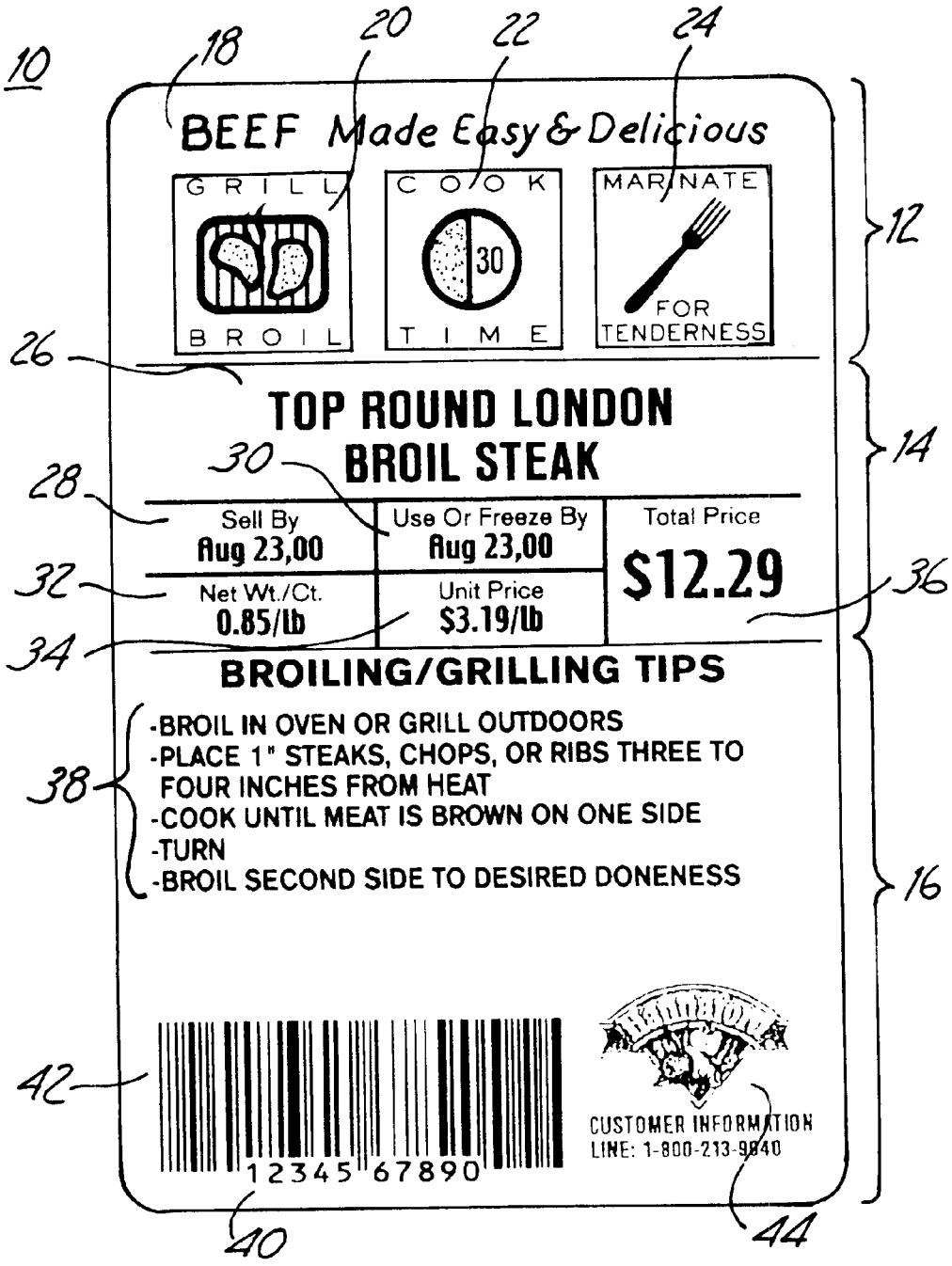
FIG. 1 is a top view of a meat product label according to one embodiment of the present invention.

FIG. 1 shows a top view of a meat product label 10 according to the present invention. As shown in FIG. 1, the meat product label 10 includes an upper portion 12, a middle portion 14, and a lower portion 16. The upper portion 12 includes a meat type description 18, a cooking method symbol 20, a cook time symbol 22, and a marinade symbol 24. The symbols represent preparation characteristics of the particular meat product to which the label is attached. In one embodiment of the present invention, the upper section 12 does not include a meat type description 18. In one embodiment, the upper section 12 includes only one of the symbols 20, 22, 24 relating to a preparation characteristic of the meat product. In other embodiments of the present invention, the upper section 12 includes a combination of two or more symbols, as will be discussed in greater detail below.

The term "meat product," as used in this specification, refers to any given cut of meat from any red meat animal, poultry, fish, or shell fish. The term "red meat animal," as used in this specification, includes all age classes of bovine (e.g., cattle steers, heifers, cows, bulls, and buffalo), porcine (e.g., sows, gilts, barrows, boars, and pigs), and ovine (e.g., sheep and lamb) animals.

The middle section 14 of the meat product label 10 includes a product description 26, a sell-by date 28, a use-by date 30, a net weight 32, a unit price 34 and a total price 36. In an embodiment of the present invention, the middle section 14 includes only the product description 26, the sell-by date 28, the net weight 32, and the total price 36.

The lower section 16 of the meat product label 10 includes cooking tips 38, a product look-up code ("PLU") 40, and a bar code 42. The PLU code is used as an index, and a PLU code is associated with each of approximately 400 meat products commonly sold by meat product retailers. The PLU code is typically used, in conjunction with a computer-based system, to "look up" the product description and price. In one embodiment of the present invention, the lower section 16 also includes a retailer logo 44. In one embodiment of the present invention, the lower section 16 of the label 10 is blank and does not include any of the items shown in FIG. 1. In one embodiment of the present invention, the lower section 16 of the meat product label 10 does not contain a PLU code, or a bar code derived from that PLU code, but, alternatively, it includes a universal product code ("UPC") that embodies both the PLU code and the product price.

In one embodiment of the present invention, all of the other information including meat product description, weight, and price, is not included on the meat product label 10, but may be present on a second label applied to the meat product. In this embodiment, the meat product label 10 includes only one or more symbols representative of a preparation characteristic of the meat product.

Figure 2:
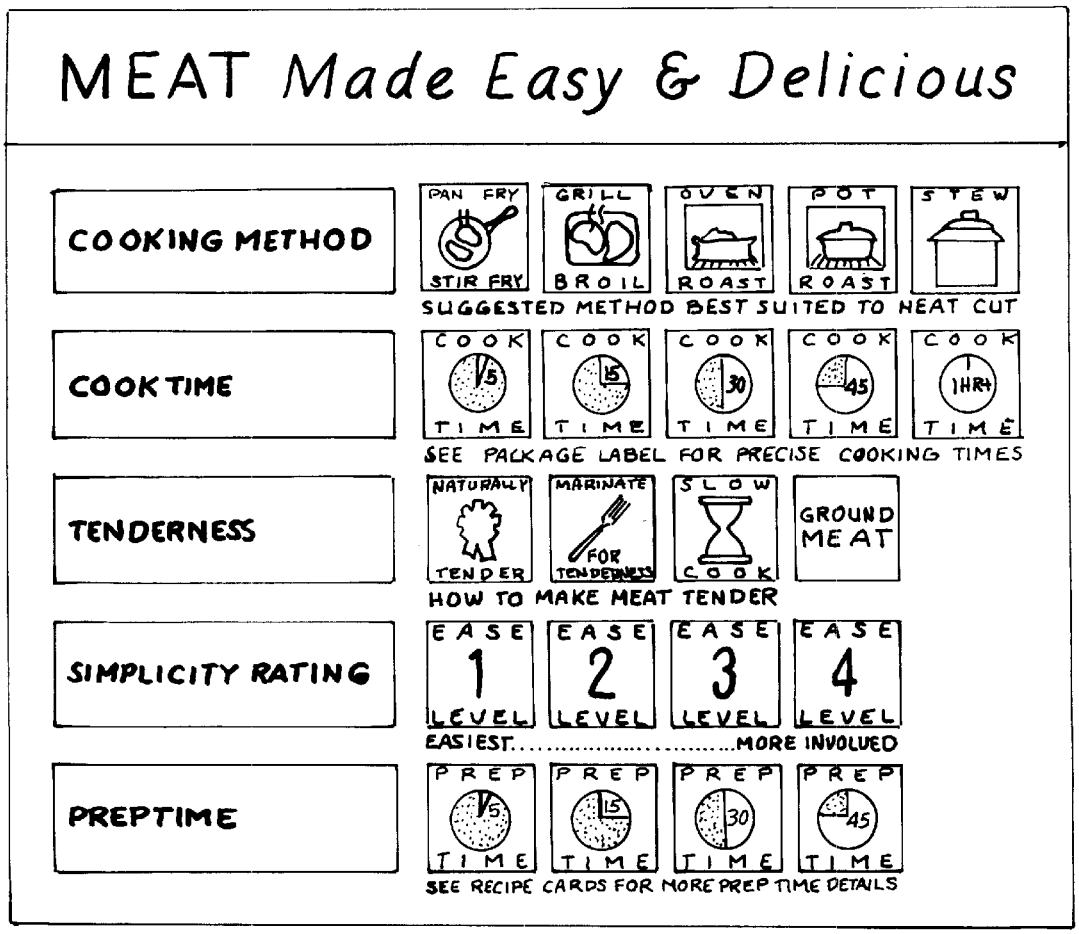
FIG. 2 is a diagrammatic view of a legend showing the various meat product preparation characteristics used with the meat product label according to one embodiment of the present invention.

As discussed above, the upper section 12 of the meat product label 10 includes one or more symbols 20, 22, 24 for conveying information about the preparation characteristics of the meat product. FIG. 2 is a diagrammatic view of a legend showing the various icons that are used to convey meat product preparation characteristics in one embodiment of the present invention. Although specific preparation characteristic categories and specific icons are shown in FIG. 2, it is not critical to the present invention that these specific icons be used. The features of the symbols or icons shown in FIG. 2, that are important to the present invention, include providing useful information and providing information in a easy-to-read format. One of ordinary skill in the art could readily envision other categories or other symbol designs that meet these requirements.

The symbols or icons shown in FIG. 2 include a basic graphical design representative of the information conveyed by the symbol. For example, in the embodiment shown in FIG. 1, the symbol 20, representing the cooking method, is a simple pictorial view of a meat product on a grill or broiler. In one embodiment, the symbols also include simple text that functions in combination with the graphical design to convey the preparation information.

As shown in FIG. 2, the preparation characteristic categories include cooking method 50, cook time 52, tenderness 54, simplicity rating 56, and prep time 58. In one embodiment of the present invention, the symbols corresponding to each of the preparation characteristics are printed on a particular background color to further facilitate the consumer in absorbing the preparation information. In one embodiment employing color backgrounds, the cooking method 50 symbols are printed on a red background, because red is representative of heat used in cooking. The cook time 52 symbols are printed on a light blue background, because blue is a calming, non-inflammatory color. The tenderness 54 symbols are printed on a yellow background. The simplicity rating 56 symbols are printed on a green background, because green has a positive, enabling impact on consumers and suggests that they are capable of preparing the product. The prep time 58 symbols are printed on a dark blue background, again because blue is a calming, non-inflammatory color. In other embodiments, other colors are used to represent the various preparation characteristics.

In one embodiment of the present invention, the cooking method 50 includes five sub-categories, as shown in FIG. 2. The five cooking methods are represented by the symbols or icons shown, including a pan fry or stir fry symbol 60, a grill or broil symbol 62, an oven roast symbol 64, a pot roast symbol 66, and a stew symbol 68. These five categories are typical methods of cooking various cuts of meat products, and substantially all meat products or cuts can generally be placed in one of these categories. One having ordinary cooking skills would know how to prepare a meat product using one of the identified cooking methods. The cooking method symbols 60, 62, 64, 66, 68 include descriptive words and a graphical representation of the particular cooking method. In other embodiments of the present invention, the cooking method category 50 includes further sub-categories and associated symbols corresponding to additional meat product cooking methods. The cooking method symbols 60, 62, 64, 66, 68 allow the consumer to readily choose a meat product that requires a mode of preparation that the consumer is comfortable with or enjoys employing.

In one embodiment of the present invention, as shown in FIG. 2, the cook time category 52 includes five sub-categories. These sub-categories are represented by the symbols shown in FIG. 5, including a five-minute symbol 70, a fifteen-minute symbol 72, a thirty-minute symbol 74, a forty-five-minute symbol 76, and a one-hour symbol 78. The cook time symbols 70, 72, 74, 76, 78 include the words "cook time" and include a graphical representation of the cook time based on an amount of a circle that remains shaded. In another embodiment of the present invention, the cook time category 52 includes fewer than five sub-categories. In another embodiment of the present invention, the cook time category 52 includes more than five sub-categories. The cook time symbols 70, 72, 74, 76, 78 include suggested cooking time for a specified meat product. These symbols allow the consumer to readily choose a meat product that requires a preparation time that fits the consumer's schedule.

The tenderness category 54 in the embodiment of the present invention, as shown in FIG. 2, includes four sub-categories. These four sub-categories are represented by symbols, including a naturally tender symbol 80, a marinade symbol 82, a slow cook symbol 84, and a ground meat symbol 86. The tenderness symbols 80, 82, 84, 86 include both description words and description graphical representations. One of skill in the art could readily envision other graphical representations that would function effectively with the tenderness symbols 80, 82, 84, 86. In another embodiment of the present invention, the tenderness category 54 includes more than four sub-categories. In another embodiment of the present invention, the tenderness category 54 includes fewer than four sub-categories. The tenderness symbols 80, 82 ,84, 86 provide simple and easy to understand information to the consumer on what steps, if any, should be performed to generate a tender end product. The tenderness 54 symbols allow the consumer to readily choose a meat product that has the desired tenderness or requires a tenderizing action.

As shown in FIG. 2 in one embodiment of the present invention, the simplicity rating category 56 includes four sub-categories. These sub-categories are represented by symbols, including ease level 1 symbol 88, ease level 2 symbol 90, ease level 3 symbol 92, and ease level 4 symbol 94. As shown in FIG. 2, these symbols 88, 90, 92, 94 consist of the words "ease level" and a number 1, 2, 3, or 4. In other embodiments of the present invention, the simplicity rating category 56 may include more or fewer sub-categories. The simplicity rating icons 88, 90, 92, 94 provide easy to understand information to the consumer on the level of complexity required for preparation of the particular meat product, so that the consumer can pick an appropriate meat product.

In the embodiment of the present invention shown in FIG. 2, the prep time (i.e., preparation time) category 58 includes four sub-categories. These sub-categories are represented by symbols including a five-minute symbol 96, a fifteen-minute symbol 98, a thirty-minute symbol 100, and a forty-five-minute symbol 102. Each of the prep time symbols 96,98, 100, 102 includes the words "prep time" and a graphical representation of the amount of time required for preparation. In other embodiments of the present invention, more or fewer prep time symbols are used. The prep time symbols 96,98,100,102 provide easy to understand information to the consumer on the amount of preparation time required for the particular meat product prior to cooking of the meat product. Typically the simplicity rating sub-categories and the prep time sub-categories are directly related. In other words, if a particular meat product has a preparation time of five minutes (symbol 96 in FIG. 2), it will have a simplicity rating of 1 (symbol 88 in FIG. 2). In some situations, however, the simplicity rating and the preparation time may not correspond directly. For example, a higher simplicity rating may be assigned if a more advanced or complex piece of equipment is required for the preparation of the meat product.

Figure 3:
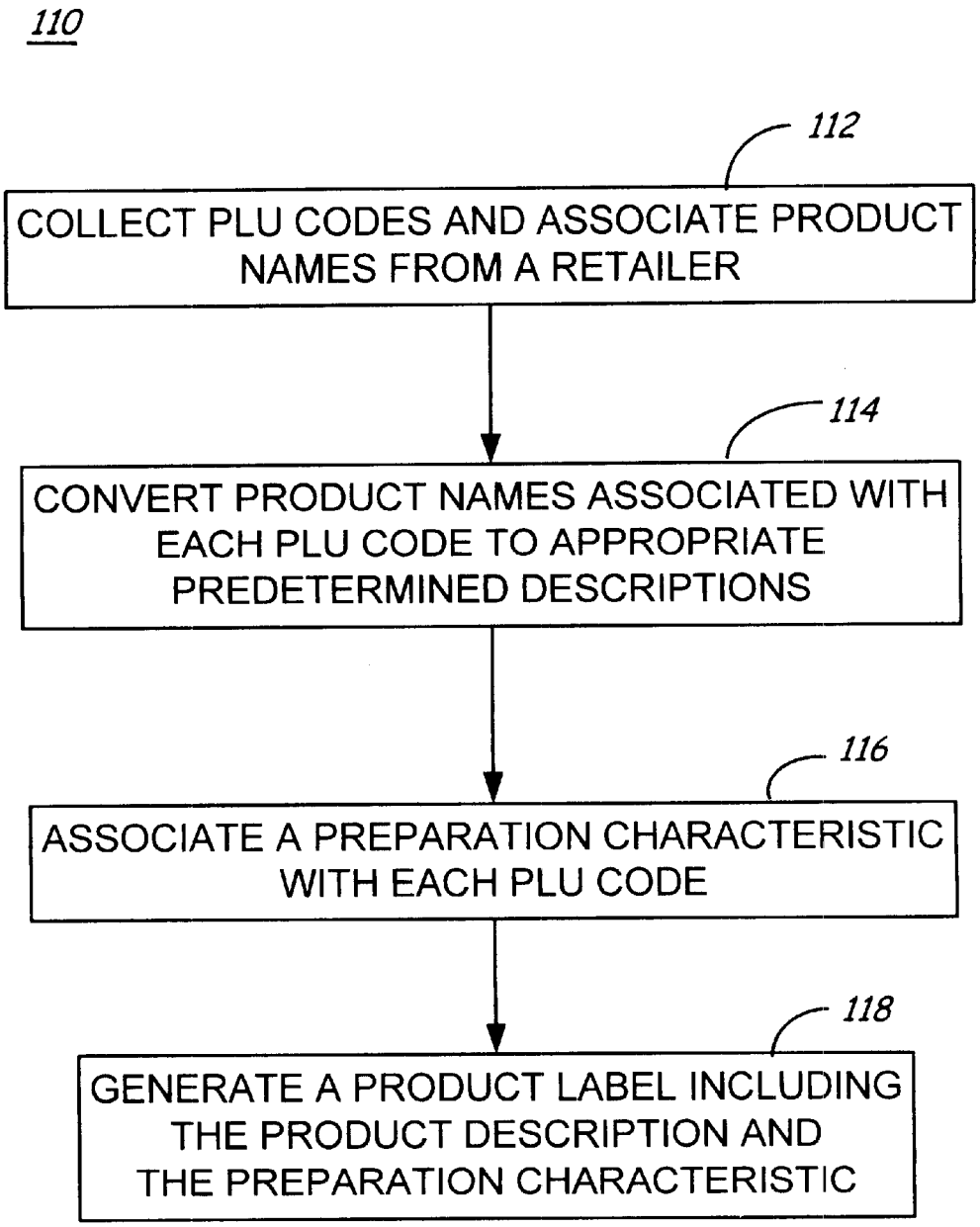
FIG. 3 is a flow chart showing a label generating method according to one embodiment of the present invention.

FIG. 3 is a flowchart illustrating a meat product label generating method 110 according to one embodiment of the present invention. As shown in FIG. 3, the label generating method 110 includes collecting PLU codes for a retailer (block 112), converting the descriptions associated with each PLU code to an appropriate predetermined description (block 114), associating a preparation characteristic with each of the PLU codes (block 116), and generating a product label including the product description and the preparation characteristic (block 118). As will be described in more detail below, other embodiments of the present invention include fewer or more elements than those shown in FIG. 3.

Collecting PLU codes from a retailer (block 112) involves the retailer providing a list of each of its PLU codes representing distinct meat products and an associated description. In one embodiment, the information collected from the retailer further includes a recommended sell-by date, a recommended use-by date, and a unit price or a price per pound associated with the PLU code. The list of PLU codes may be provided by the retailer in either a hard copy or in an electronic format. In one embodiment of the present invention, the PLU codes and associated information are generated independently.

In one embodiment of the present invention, after the list of PLU codes is collected from the retailer, the product descriptions associated with each PLU code are converted to predetermined purchaser or consumer oriented product descriptions (block 114), where appropriate. A set of predetermined meat product descriptions is ascertained by viewing menus from restaurants in the retailer's geographic region to determine the names that restaurants typically give to a particular meat product, to determine which of a multiplicity of valid names should be assigned to a meat product. Assigning the product name or product description in view of restaurant menus acts to insure that the name assigned to a particular meat product is that name typically used in a geographic region. If a name commonly used to refer to a meat product in a specific geographic region is applied to that meat product, it may be better received by the retailer's consumers, and, therefore, sales may be greater than if another name was applied to the meat product. In one embodiment of the present invention, the converting process is not performed, but, instead, the product names provided by the retailer or independently generated are used to generate the label.

Next, a preparation characteristic is associated with each PLU code (block 116). In one embodiment, this association is performed manually by a person reviewing the list of PLU codes from the retailer and assigning a preparation characteristic based on that person's knowledge of the various meat products. In another embodiment of the present invention, this association is performed on a computer-based system having a look-up table associating each PLU code with a predetermined preparation characteristic. In one embodiment, the preparation characteristic includes one of the five categories shown in FIG. 2. In other embodiments, other preparation characteristics are used. In one embodiment of the present invention, three preparation characteristics are associated with each meat product PLU code, including recommended cooking method, recommended cooking time, and tenderness suggestions. FIGS. 4A–4C illustrate sample labels including symbols for cooking method, cooking time, and tenderness. FIG. 4A shows a sample "brisket" label 120, FIG. 4B shows a sample "stir fry" label 122, and FIG. 4C shows a sample "loin roast" label 124. In other embodiments, more than three preparation characteristics are associated with each PLU code.

If the preparation characteristic to be assigned to each PLU code is the cooking method 50, it is assigned based on the most commonly employed or the recommended cooking method for the meat product corresponding to the PLU code. For example, if the meat product is "brisket," the pot roast symbol 66 is assigned (as shown in FIG. 4A). If the meat product is "stir fry," the pan fry or stir fry symbol 60 is assigned (as shown in FIG. 4B). If the meat product is "loin roast," the oven roast symbol 64 is assigned (as shown in FIG. 4C). Likewise, the cook time 52 and tenderness 54 symbols are assigned based on experience and knowledge of those skilled in the art. FIGS. 4A–4C show sample cook time and tenderness assignments to specified meat products. In embodiments including simplicity rating 56 and prep time 58, the symbols are again assigned based on knowledge and experience of one skilled in the art.

After a preparation characteristic is associated with each PLU code, a product label including the product description and the preparation characteristic is generated (block 118). In one embodiment of the present invention, the generated label has the format shown in FIG. 1 (also shown in FIGS. 4A–4C). One of skill in the art can readily envision other formats for the product label that are equally effective. In one embodiment of the present invention, the product label is generated by hand. In another embodiment of the present invention, the product label is generated on a label generating scale such as the Quantum Service Scale System made by Hobart Corporation in Troy, Ohio, as described in Hobart Form F-7720 (Rev. 1295) (available on Hobart website at http://www.hobartcorp.com). A commercially available scale may be readily modified by those with skill in the art to generate a label containing icons or symbols representing a preparation characteristic.

In one embodiment of the present invention, the label generating method 110 further includes placing information such as a sell-by date, a use-by date, a net weight, a unit price, and a total price on the label. In one embodiment the present invention, detailed cooking tips are also provided in a section of the label. In one embodiment of the present invention, the preparation characteristics are represented by a set of symbols having a uniform look and format such that the consumer viewing the symbols can quickly and easily determine the preparation characteristics associated with a given meat product. In one embodiment of the present invention, the product characteristic symbols are placed near the top of the label so that the consumer looks to the symbols before viewing the other information on the label. In one embodiment of the present invention a meat type description 18 (shown in FIG. 1) is also applied to the label. The meat type description 18 is generated by filling in a rectangular white space on the label, such that the meat type appears in the color of the label itself. In another embodiment, the meat type description 18 is printed on the label.

Figure 5:
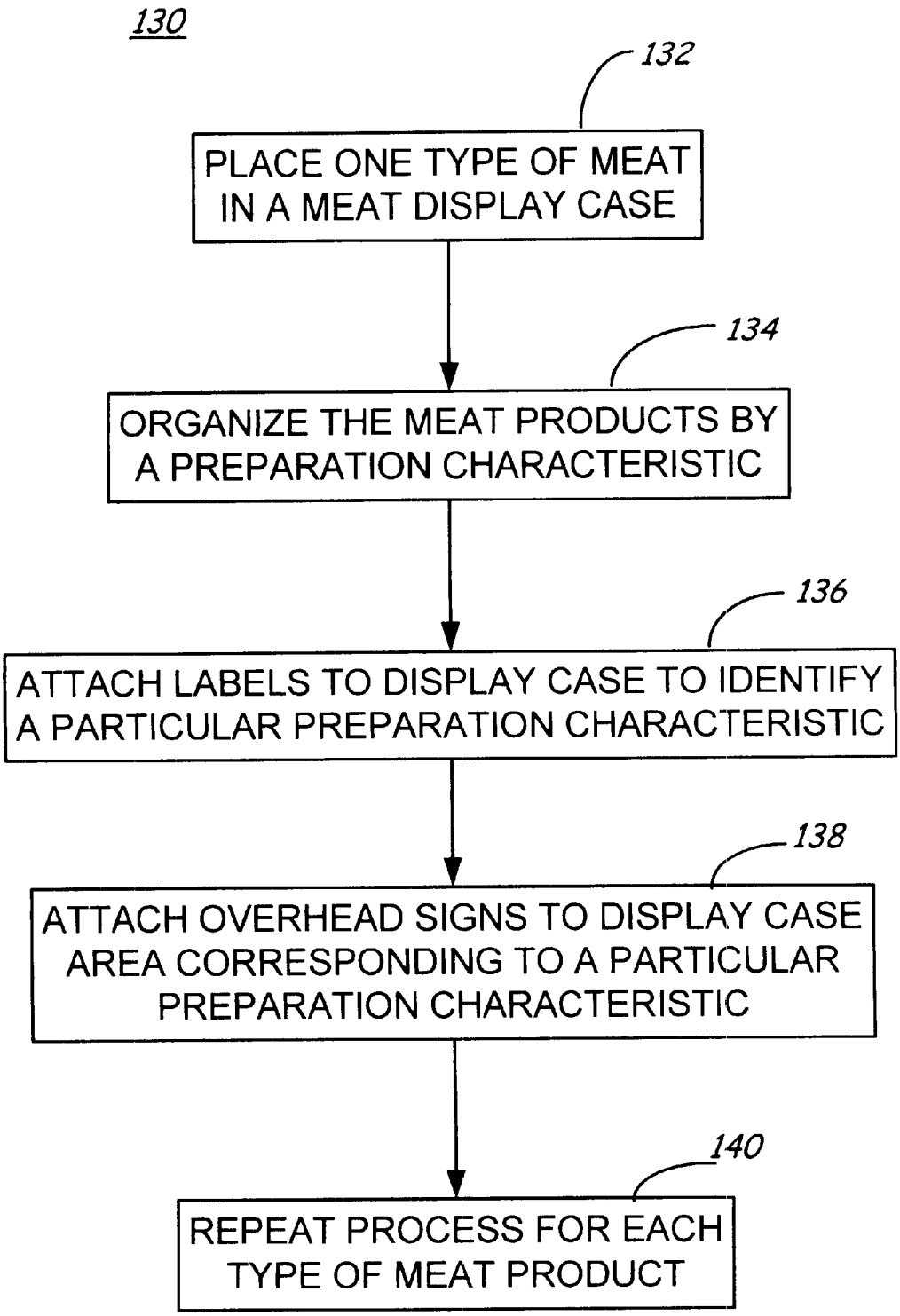
FIG. 5 is a flow chart showing a meat product display case organizational method according to one embodiment of the present invention.

FIG. 5 is a flow chart showing an organizational method 130 for organizing a meat display case. As shown in FIG. 5, the method includes placing one type of meat product (e.g., beef, pork, chicken, fish, and shell fish) in a display case (block 132), organizing the meat product by the preparation characteristic (block 134), attaching labels to the display case to identify a portion of the display case as corresponding to a particular preparation characteristic (block 136), attaching overhead signs to the display case area corresponding to a particular preparation, characteristic (block 138), and repeating the process for each additional type of meat product (block 140).

The organizational method 130 first involves placing one type of meat product in the display case (block 132). For example, all beef products may be placed in the display case. Next, the meat products are organized according to a preparation characteristic (block 134). In one embodiment of the present invention, the preparation characteristics are those shown in FIG. 2. As discussed, other preparation characteristics known to those with skill in the art may also be used. In one embodiment of the present invention, this organization is performed by placing meat products corresponding to a particular preparation characteristic on separate shelves of the display case (i.e., one preparation characteristic is located above or below another). For example, the meat product could be organized according to the five categories of cooking time shown in FIG. 2. In this embodiment, one shelf of the meat case would correspond to each of the cooking time categories, such that the meat products are separated vertically. In other embodiments of the present invention, the meat products are organized by other preparation characteristics. In other embodiments of the present invention, the meat products are organized by separating them by preparation characteristic horizontally along the length of the meat case.

Next, labels are attached to the meat display case to identify a particular portion of the display case as corresponding to a particular preparation characteristic (block 136). In one embodiment of the present invention, labels attached to the display case are not used. Next, overhead signs are attached to the display case area corresponding to a preparation characteristic (block 138). In one embodiment of the present invention, overhead signs are not used.

Finally, the process shown in FIG. 5 is repeated for each meat product. For example, there may be beef products, pork products, chicken products, and fish products all in one meat display case. In one embodiment of the present invention, the organizational method 130 further includes attaching recipes to the display case at appropriate locations corresponding to meat product type and preparation characteristics. In another embodiment of the present invention, symbol legends, such as that shown in FIG. 2 are also attached to one or more locations in the meat display case for convenience of the consumer. This organizational method 130 allows consumers to quickly and readily find a meat product, and accordingly it improves the volume of meat products sold by retailers.

Figure 6:
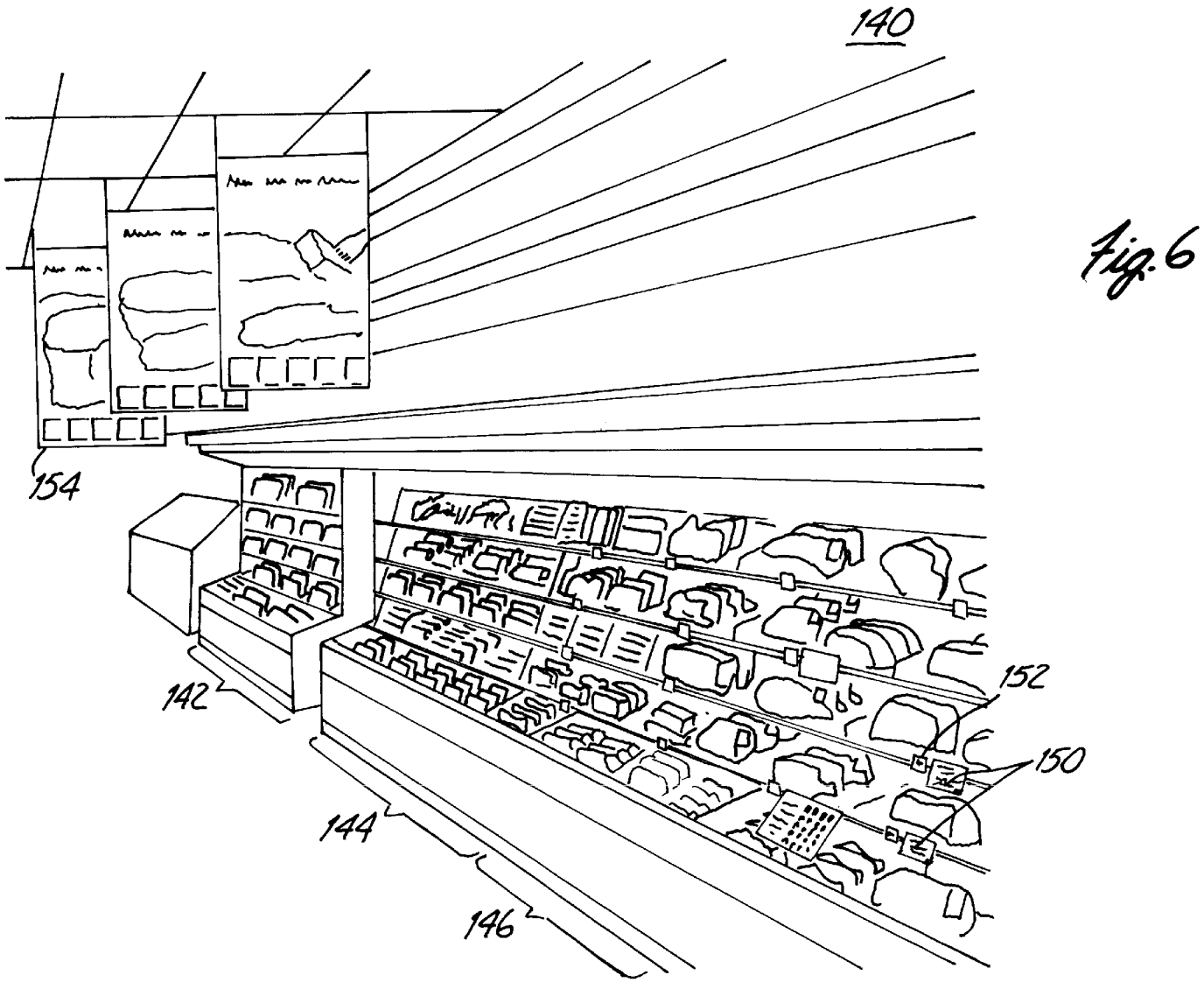
FIG. 6 is a perspective view of a retail meat product display case according to one embodiment of the present invention.

FIG. 6 is perspective view of a meat display case 140 according to one embodiment of the present invention. As shown in FIG. 6, meat products are organized by type and preparation characteristics. The display case shown in FIG. 6 holds pork products 142, ground beef products 144, and beef products 146 separated horizontally along the length of the display case 140. As also shown, symbol legends 148 (such as that shown in FIG. 2), recipe cards 150, and preparation symbols 152 (corresponding to symbols in the symbol legend 148) are attached to the meat display case 140 at appropriate locations. Finally, in one embodiment, overhead signs 154 are used to identify particular locations of particular meat types in the display case.

Although the present invention has been described with reference to preferred embodiments, workers skilled in the art will recognize that changes may be made in form and detail without departing from the spirit and scope of the invention.

I claim:

1. A method of labeling a meat product with characteristic preparation information, the method comprising:

collecting a plurality of meat product PLU codes and corresponding product descriptions;

associating a first preparation characteristic with the meat product, wherein the first preparation characteristic is a recommended cooking time or an estimated preparation time;

associating a second preparation characteristic with the meat product, wherein the second preparation characteristic is a recommended cooking method;

selecting a first symbol representing the first preparation characteristic;

selecting a second symbol representing the second preparation characteristic; and applying a product label, including the first symbol and the second symbol, to the meat product.

2. The method of claim 1 further comprising, after the collecting step, the step of converting the product description corresponding to at least one of the plurality of PLU codes to a predetermined description, wherein the predetermined description is consumer oriented.

3. The method of claim 2 wherein the appropriate predetermined description is derived by reviewing local restaurant menus, in a given geographic region, to determine the name most commonly associated with the product associated with the at least one PLU code.

4. The method of claim 1 wherein the first and second symbols are graphical representations of the first and second preparation characteristic.

5. The method of claim 1 wherein the first and second symbols are graphical representations of the first and second preparation characteristic containing simple text corresponding to the first and second preparation characteristic.

6. The method of claim 1 wherein the recommended cooking method is selected from the group consisting of: pan fry, grill, oven roast, pot roast, and stew.

7. The method of claim 4 wherein the first preparation characteristic is a recommended cooking time for the meat product.

8. The method of claim 7 wherein the recommended cooking time is selected from the group consisting of: five to fifteen minutes, fifteen to thirty minutes, thirty to forty-five minutes, forty-five to sixty minutes, and over one hour.

9. The method of claim 1 or 2 further including associating a third preparation characteristic with the meat product, wherein the third preparation characteristic is a tenderness rating for the meat product, and further wherein the product label includes a third symbol representing the third preparation characteristic.

10. The method of claim 9 wherein the tenderness rating is selected from the group consisting of: naturally tender, marinade, slow cook, and ground meat.

11. A method of labeling a meat product with characteristic preparation information, the method comprising:

associating a first preparation characteristic with the meat product, wherein the first preparation characteristic is a recommended cooking time or an estimated preparation time;

associating a second preparation characteristic with the meat product, wherein the second preparation characteristic is a recommended cooking method;

associating a third preparation characteristic with the meat product, wherein the third preparation characteristic is a simplicity rating for the meat product;

selecting a first symbol representing the first preparation characteristic;

selecting a second symbol representing the second preparation characteristic;

selecting a third symbol representing the third preparation characteristic; and applying a product label, including the first symbol, the second symbol, and the third symbol to the meat product.

12. The method of claim 11 wherein the simplicity rating is selected from the group consisting of: ease level one, ease level two, ease level three, and ease level four.

13. A method of labeling a meat product with characteristic preparation information, the method comprising:

associating a first preparation characteristic with the meat product, wherein the first preparation characteristic is an estimated preparation time for the meat product;

associating a second preparation characteristic with the meat product, wherein the second preparation characteristic is a recommended cooking method;

associating a third preparation characteristic with the meat product, wherein the third preparation characteristic is a recommended cooking time;

selecting a first symbol representing the first preparation characteristic;

selecting a second symbol representing the second preparation characteristic;

selecting a third symbol representing the cooking time; and applying a product label, including the first symbol, the second symbol, and the third symbol, to the meat product.

14. The method of claim 13 wherein the estimated preparation time is selected from the group consisting of: up to five minutes, up to fifteen minutes, up to thirty minutes, and up to forty-five minutes.

15. The method of claim 7 wherein the second symbol is placed over a red background.

16. The method of claim 1, 11, or 13 wherein the third symbol is placed over a green background.

17. The method of claim 1, 11, or 13 wherein the applying a product label step further includes printing verbal cooking tips, associated with the meat product, on the product label.

18. The method of claim 1, 11, or 13 wherein the associating step is performed manually by a person assigning the at least one preparation characteristic based on the person's knowledge of the meat product.

19. The method of claim 1, 11, or 13 wherein the associating step is performed on a computer-based system by using a look-up chart to determine the at least one preparation characteristic corresponding to the meat product.

* * * * *